United States Patent [19]

Stephens

[11] 3,984,595

[45] Oct. 5, 1976

[54] INFLATABLE RUG

[75] Inventor: Donald J. Stephens, Bronx, N.Y.

[73] Assignee: Lawrence Peska Associates, Inc., New York, N.Y. ; a part interest

[22] Filed: Aug. 20, 1975

[21] Appl. No.: 606,220

[52] U.S. Cl. ..... 428/35; 5/344; 5/345 R; 428/95

[51] Int. Cl.[2] ..... A47C 27/08

[58] Field of Search ..... 428/85, 95, 35; 5/344, 5/345 R

[56] References Cited

UNITED STATES PATENTS 3,813,716 6/1974 Francis ..... 5/344

*Primary Examiner*—Marion E. McCamish
*Attorney, Agent, or Firm*—Jack D. Slobod

[57] ABSTRACT

A rug which is convertible to an air mattress includes a rug member adhesively laminated on top of a flexible-walled backing member composed of a pair of stacked sheets sealably joined around their margins. A valve is provided through the backing member to enable the introduction of pressurized gas into a cavity defined between the sheets.

2 Claims, 3 Drawing Figures

INFLATABLE RUG

FIELD OF THE INVENTION

The present invention relates generally to rugs having a padding member. In its particular aspects, the present invention relates to a rug having an inflatable backing member for conversion to a rug-covered air mattress.

BACKGROUND OF THE INVENTION

Various items of furniture have heretofore been configured to enable conversion of the furniture to a bed. Further, various inflatable mattresses and pads have been known in the prior art. Such items typically because of difficulty of storage have not been configured of a size large enough to accommodate a number of people.

OBJECTS OF THE INVENTION

It is an object of the present invention to provide a floor rug which is convertible to a mattress, in order to obviate the prior art problem of storing or housing large convertible beds.

It is a further object of the present invention to provide a combined rug and an air mattress which is simple and inexpensive.

SUMMARY OF THE INVENTION

Briefly, the aforementioned and other objects of the present invention are satisfied by providing a rug member laminated on top of a flexible walled backing member composed of a pair of stacked sheets which are joined together sealably around their margins to define a cavity between the sheets. A valve is provided passing from the exterior of the backing member into the cavity to enable the selective introduction of pressurized gas into the cavity.

When not inflated, the present invention may be utilized as an ordinary floor rug, with perhaps a small amount of gas left trapped in the cavity to serve as a padding for the rug. The rug may obviously be of a large area, since no storage thereof is required, to enable conversion into a large area air mattress.

Other objects, features and advantages of the present invention will become apparent upon perusal of the following detailed description thereof when taken in conjunction with the appended drawing wherein:

FIG. 1 is a pictorial presentation of the inflatable rug of the present invention; and FIGS. 2 and 3 are each elevation cross-sectional views through the lines 2—2 in FIG. 1 illustrating two different techniques for inflating the rug.

DETAILED DESCRIPTION

Figure 1:
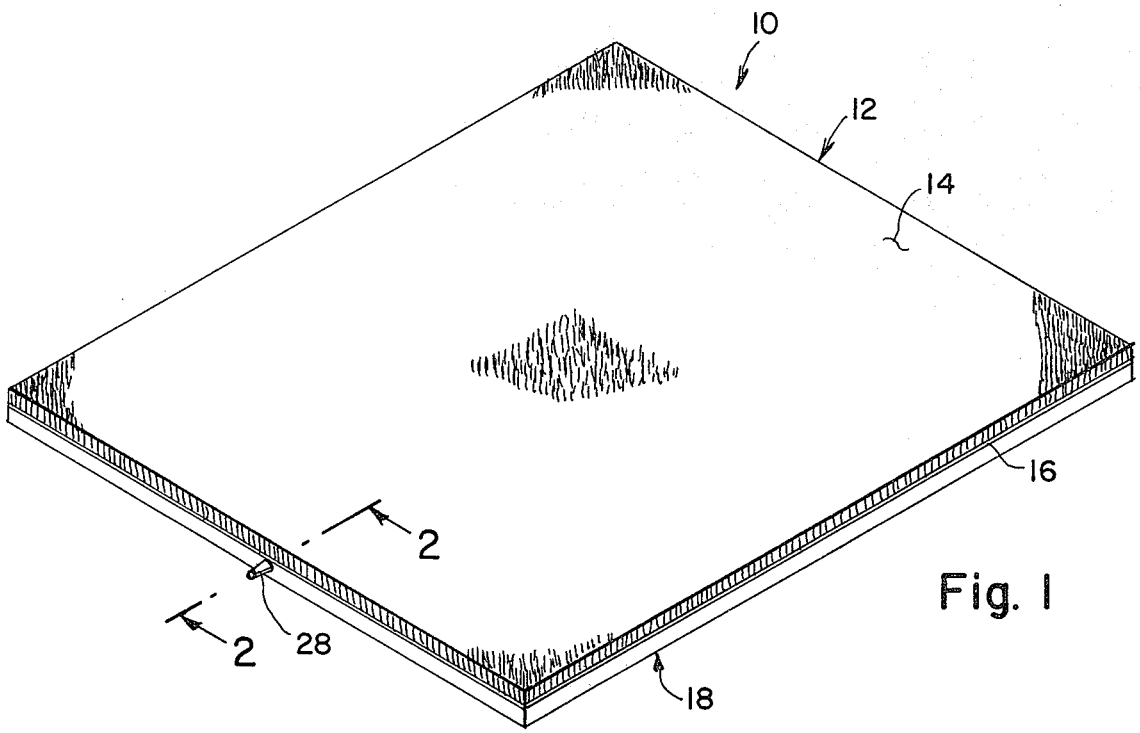
Figure 2:
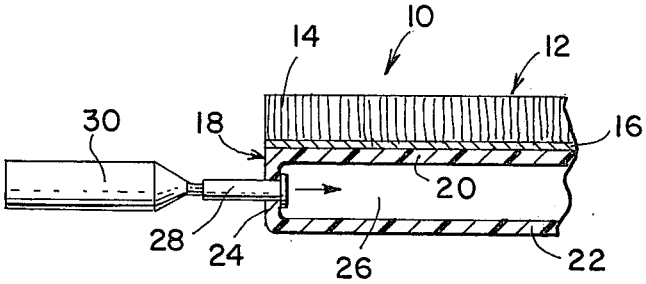
Figure 3:
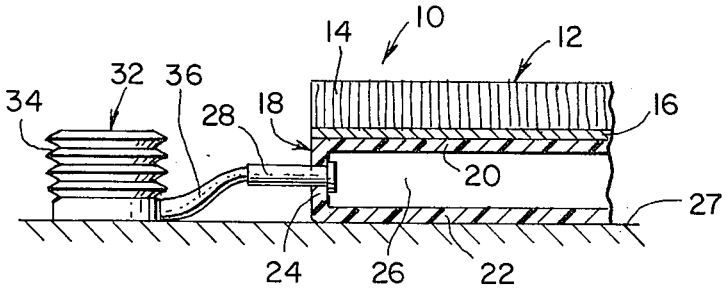

Referring to FIGS. 1 through 3 of the drawing, the inflatable rug 10 of the present invention is generally indicated by the reference numeral 10. Rug 10 comprises a rug top 12 including the usual yarn threads 14 upstanding from a conventional backing 16 as of jute mesh or non-woven polypropylene fabric. The rug top 12 is preferably of rectangular shape and may be provided in a variety of sizes such as is usual for area rugs.

In accordance with the principles of the present invention, the conventional rug backing 16 is adhesively bonded on top of a gas-tight inflatable auxiliary backing member 18. Auxiliary backing member 18 is composed of a pair of vertically stacked, flexible, nonpermeable congruent rectangular sheets 20 and 22 which are joined together sealably all around their margins as by an integral peripheral sidewall 24, as shown, or by other means such as by heat sealing. As is apparent from the drawing, the sheets 20 and 22 are each the same size as rug top 12 with the underside of conventional backing 16 being adhesively bonded onto the upper sheet 20. The sheets are preferably vinyl plastic, but may also be composed of a suitable rubber.

A cavity 26 is defined in backing 18 bounded by sheets 20 and 22 and the peripheral sidewall 24. The cavity is airtight and therefore adapted to be pressurized. However, with no gas pressure in cavity 26 the top sheet 20 rests directly on bottom sheet 22. The sheets are preferably thin so that when the cavity is not inflated, the rug 10 appears as a conventional rug on a floor 27.

To enable the introduction of pressurized gas into cavity 26 at sufficient pressure to convert the inflatable rug 10 to an air mattress a tubular air valve 28 is provided installed passing through the sidewall 24 and communicating with cavity 26. Air valve 28 may be configured for accepting a carbon dioxide capsule 30 as shown in FIG. 2 or may be provided to accept a special foot pump 32 as shown in FIG. 3.

The foot pump 32 comprises a vertically oriented cylindrical bellows member 34 which communicates with a stem 36 accepted by valve 28. As should be apparent the foot pump 32 may be permanently installed connected to valve 28 to obviate the possibility of misplacing the pump.

It should be apparent that when the inflatable rug is to serve as an area rug, the cavity 26 would normally contain no gas pressure. If a slight padding effect is desired from the auxiliary backing 18, a moderate amount of air pressure may be introduced the cavity 26. For conversion into an air mattress, the cavity 26 is fully inflated in a manner for the rug top 12 to rise several inches above the floor 27.

Having described the preferred embodiment of the present invention in specific detail it should be appreciated that numerous modifications, additions, and omissions in the details thereof are possible within the intended spirit and scope of the invention.

What is claimed is:

1. An inflatable rug comprising a rug member laminated on top of a generally planar flexible walled hollow backing member, the walls of said backing member enclosing a cavity in said member, and valve means carried by said member in communication with said cavity to enable the introduction of pressurized gas into said cavity.

2. The inflatable rug of claim 1 further comprising an adhesive bond between said rug member and said backing member.

* * * * *